United States Patent [19]

May

[11] 4,100,880

[45] Jul. 18, 1978

[54] APPARATUS FOR THE TREATMENT OF THREAD AND THE LIKE

[76] Inventor: Erhard T. May, c/o Kellenberg Strasse, D-8960 Kempten, Fed. Rep. of Germany

[21] Appl. No.: 789,418

[22] Filed: Apr. 21, 1977

[30] Foreign Application Priority Data

Aug. 11, 1976 [DE] Fed. Rep. of Germany ..... 2636058

[51] Int. Cl.[2] ..... B05C 1/08

[52] U.S. Cl. ..... 118/234; 118/246; 118/DIG. 20

[58] Field of Search ..... 118/DIG. 20, 234, 244, 118/246; 68/200, 202; 57/35

[56] References Cited

U.S. PATENT DOCUMENTS

| | | | |
|---|---|---|---|
| 1,578,241 | 3/1926 | Johnson | 68/202 |
| 1,578,242 | 3/1926 | Johnson | 68/202 |
| 2,038,789 | 4/1936 | Higgins | 118/DIG. 20 |
| 2,271,999 | 2/1942 | Gariepy | 118/234 X |

*Primary Examiner*—John P. McIntosh
*Attorney, Agent, or Firm*—Melville, Strasser, Foster & Hoffman

[57] ABSTRACT

Apparatus for the uniform treatment of thread with a treatment fluid during the winding of the thread on a cross-wound bobbin or the like driven at a constant rotational speed while the speed of the thread is increasing constantly, said apparatus comprising a treatment roller, the lower portion thereof dipping into a bath of the treatment fluid, and two thread guides. The first guide is stationary, the second is movable in a direction parallel to the axis of the treatment roller in response to the speed of the thread, the thread being stretched therebetween and lying against the periphery of the treatment roller. The roller, which is driven at a constant rotational speed, has a cylindrical first section and a second section comprised of a plurality of truncated cone surfaces; a plurality of radially disposed and axially extending small passages on the second section forming grooves having a depth of zero at the border of the cylindrical section and increasing over-proportionally to the groove length. In a second embodiment the treatment roller has a cylindrical surface only and a skimmer abutting against said surface. The skimmer is slideable along said surface in response to the increasing speed of the thread, gathering increasingly larger amounts of treatment fluid and acting to concentrate treatment fluid at the thread passing by and being guided by the free end of said skimmer.

9 Claims, 10 Drawing Figures

APPARATUS FOR THE TREATMENT OF THREAD AND THE LIKE

BACKGROUND OF THE INVENTION

The invention concerns an installation for the treatment of a thread or the like with a treatment fluid such as liquid wax, oil or the like, during the winding process of the thread on a cross-wound bobbin or the like with a constant spool spindle rotational speed, with a treatment roller driven at a constant rotational speed one part of its peripheral area dipping into a bath containing the treatment fluid, said treatment roller having on its peripheral surface axially running grooves, said installation having two thread guides the first of which is stationary while the second can be moved essentially parallel to the axle of the treatment roller and which is constructed in such a manner that the threads which are stretched between them lie against the peripheral area of the treatment roller and this over a certain length.

In known installations of this type, the threads are pulled essentially vertically with regard to the axis of the treatment roller. Since on the one hand the treatment roller turns on itself, and on the other hand dips into the bath with the treatment fluid, its peripheral area is constantly wet with the treatment fluid so that the threads can pick up the latter. Since the cross-wound bobbin or the like, on which the threads are wound, has a growing diameter, even though the number of the rotations of the spindle remains constant, the speed of the thread continually increases, which results in the fact that the wetting of the thread with the treatment liquid becomes insufficient and this because of the fact that the treatment roller, whose peripheral speed is lower than the speed of the thread, always picks up an identical quantity of treatment fluid. Therefore, when the speed of the thread increases, the thread is led more and more at an angle over the treatment roller in order to increase the contact length between the thread and the peripheral area. Through this lengthening of the line of contact one attempts to reduce the loss of wetting which occurs when the thread speed increases so that the treatment of the thread with the treatment fluid occurs in a uniform manner and so that the quantity of treatment fluid per length of thread remains the same.

Nevertheless, the experience has been that with a smooth peripheral surface of a treatment roller it is especially unsatisfactory when the covering of the thread with a treatment fluid has to be especially intensive, as for example for seam thread. It has been noted that the thread at the beginning of the winding always picks up substantially more treatment fluid than at the end of the winding process even though the contact length or surface between the thread and the treatment roller is constantly increased. An unlimited increase of the contact surface is not possible because, on the one hand the spatial relationship of the winding machine is limited, and on the other hand because in an excessive increase of the contact surface the tension of the thread can be increased to the point where it would lead to the snapping of the thread. On the other hand a special intensive absorption, especially for a seam thread, of the treatment fluid is a requirement since the number of stitches in modern sewing machines (stitch per unit of time) has constantly increased and is still increasing.

Regardless of the above mentioned considerations against a further increase of the contact surface, the prior art has already thought of designing the treatment roller in a conical form in which the thread at increasing thread speed can be shifted to the areas of the larger diameter of the cone. Regardless of the increased thread tension it became clear that by this no substantial improvement could be obtained since the treatment fluid indicated a tendency to flow toward the tip, i.e. the smaller diameter of the cone. As a result of this the coating thickness of the treatment fluid is at its strongest where it is not desired, namely in the area of the roller which the thread touches at the beginning of the winding process.

Further, the prior art has attempted to install, between to co-axial spaced-apart circular discs, studs along the length of the discs, which thus represent the circumference of the roller. These studs are put on in an angle and are also constructed in a conical form; nevertheless this did not result in an improvement since the treatment fluid dripped off from these studs. Furthermore, one also has build into a cylindrical treatment roller wedge-shaped grooves which begin on the front side of the treatment roller and which continually advance and end in a point at the other front side of the treatment roller, in which the thread in the neighborhood on one such area is shifted towards the other front side and this in accordance with the increasing diameter of the bobbin and the increasing speed of the thread. Nevertheless, the distribution of the treatment fluid remained unsatisfactory.

SUMMARY

The problem which this invention has to address is to create an installation of the type mentioned above which permits a uniform treatment of the thread with a treatment fluid, without an increase of the contact zone between the thread and the treatment roller of such magnitude that it will result in an intolerable increase of the tension of the thread, and which also avoids the above mentioned disadvantages.

According to the invention this task is solved by the provision of a treatment roller having a cylindrical first circumference segment area adjacent the one front side of the roller and a second circumference segment area adjacent thereto having radially front standing, axially elongated small webs, whose edges continue the peripheral area of the cylindrical circumference section, and between them are provided grooves, the depths of the grooves, on the inner border line of the cylindrical circumference segment area, beginning with the value zero and towards the other front side of the treatment roller increasing overproportionally to the groove length.

The thread which is to be treated lies in the beginning of the operation within the area of the second circumference section on the free edges of the webs and absorbs fluid there because of the present relatively small contact surface and the corresponding low thickness of the film of the treatment fluid and a proportionally low, in relation to the low speed of the thread, quantity of treatment fluid is taken up. It is to be understood that the arrangement is made in such a manner that the thread can absorb the quantity of treatment fluid which is desired. With the increasing speed of the thread, the thread is conducted at an ever increasing inclination and because of this it enters at least partially into the cylindrical, i.e. the first circumference section, in which the coating thickness of the film of the treatment fluid is at its highest. It has been proved that in this manner a uniform coating of the thread with the treatment fluid can be obtained throughout the overall winding process.

In the determination of the width of the first, cylindrical circumference section and the diameter of the treatment roller one sees to it that the quantity of the treatment fluid, which the thread absorbs at the greatest inclination and the greatest thread speed and thread tension, gives the desired quantity. On the basis of this, the width of the webs which stretch to the other front side of the treatment roller and the modifying groove depths are determined so that this quantity cannot be exceeded.

By way of definition it is noted that an over-proportionally increasing groove depth should be understood to mean that with the increasing groove length it does not (or not constantly) increase in a linear manner. In an (described below) embodiment the second circumference section of the treatment roller consists of several truncated cone surfaces bordering on each other with increasingly truncated opening angles to the other front side. This means that, over a specific distance, specifically in the area of the constant opening angle of the first truncated cone, a linear increase of the groove depth occurs; however, the linear increase is not maintained because the second truncated cone has a greater truncated opening angle, so there the groove depth increases more strongly with the increasing groove length, when also again in linear fashion. The greater the number of cones of this type, i.e. truncated cone surfaces, the more the basis of the grooves approaches a constantly curved surface. If, furthermore, one sees to it that in the direction of the other front side the truncated cones which follow upon each other have decreasing heights, then in the end one obtains a curvature which shows no constant curve radius but a curve radius decreasing constantly towards the other front side. In an indefinite number of truncated cones one obtains indeed as second circumference section a rotational symmetrical surface which towards the other front surface of the treatment roller has a curvature always increasing towards the axis of the treatment roller.

It is advantageous that the roller be in one piece up to the webs. The treatment roller in accordance with the invention allows itself also to be made in one piece, but this would nevertheless be complicated and expensive. It is preferred that in the circumference surface of the treatment roller are installed radially and at specific distance, axial slits, in which substantially rectangular plates are inserted in a fixed position, said plates corresponding in its length to the width of the roller and forming the webs. Preferably, the free edges of the plates form generatrices of a cylindrical surface in space and, at the borderline of the first circumference segment area, merge into the cylindrical peripheral area of the treatment roller.

Preferably several truncated conical surfaces are present, in which the height of the truncated cones bordering on each other diminish towards the other front side in such a manner that in the first approach an increasingly stronger curving towards the axis of the treatment roller occurs. Such a rotational symmetrical, on the inner borderline of the cylindrical circumference segment area of the treatment roller going over in the same, towards the other front side increasingly curved surface can have an intersection circle diameter about 10 cm smaller than the diameter of the treatment roller.

At the beginning of the winding process the thread lies exclusively against the free edges of the webs or plates, respectively, and absorbs the treatment fluid being there and having a relatively thin film thickness. With the increasing diameter of the bobbin and the corresponding increase of the thread speed, the thread travels in the above described maner towards the right and as such assumes an angle and thus comes within the area of the lower groove depths and from this it follows that the film of treatment fluid becomes thicker on the edges of the webs. Finally the thread comes at least partially in the area of the cylindrical circumference surface where the film of the treatment fluid is especially thick. The result is an exceptional uniform coating of the thread with the treatment fluid, independent of the specific speed of the thread.

A further solution of the problem of the invention using a treatment roller with smooth cylindrical circumference surface is characterized by a skimmer which, depending on the speed of the thread can be moved from the other front side of the treatment roller to the one front side, with its covering length lying against the circumference surface of the treatment roller; said skimmer being formed in such a manner that the skimmed treatment fluid concentrates in an area of the treatment roller in which the thread is led.

Because of this development the skimmer skims the entire treatment fluid over the specific width of the treatment roller, which it covers (covering length) and conducts it towards the running through thread. At the beginning of the winding process, the free end of the skimmer is located near the other front side, so that a relatively small amount of treatment fluid is skimmed off. At this point in time, very little treatment fluid is required in order to properly treat the thread. The higher the speed of the thread, the further the skimmer travels over the circumference surface and a consequently larger quantity of treatment fluid is skimmed off and conducted to the thread that moves with the skimmer. One can see to it that the skimmer at the same time takes over the function of a thread guide. Suitably the width of the skimmer corresponds at least to the width of the treatment roller and its movement can take place parallel to the axis of the treatment roller. Shortly before the end of the winding process, i.e. at the highest diameter of the bobbin and correspondingly high speed of the thread, the thread is already located near the one front side of the treatment roller, i.e. the skimmer skims the treatment fluid off almost the entire circumference surface of the treatment roller and leads this relatively large quantity of treatment fluid towards the thread.

DESCRIPTION OF THE DRAWINGS

The invention and its preferred embodiments are explained below on the basis of the exemplary executions represented in the drawings.

It is to say.

DESCRIPTION OF THE PREFERRED EMBODIMENTS

Figure 1:
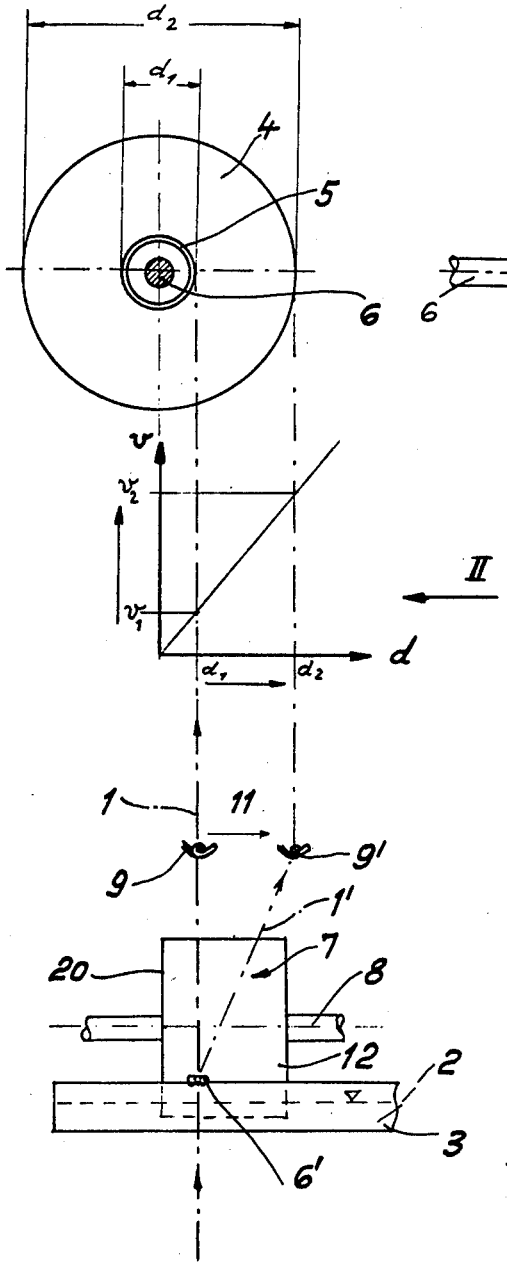
FIG. 1 — a schematic representation of the relationships in an installation for the winding of a thread with simultaneous thread treatment.
Figure 2:
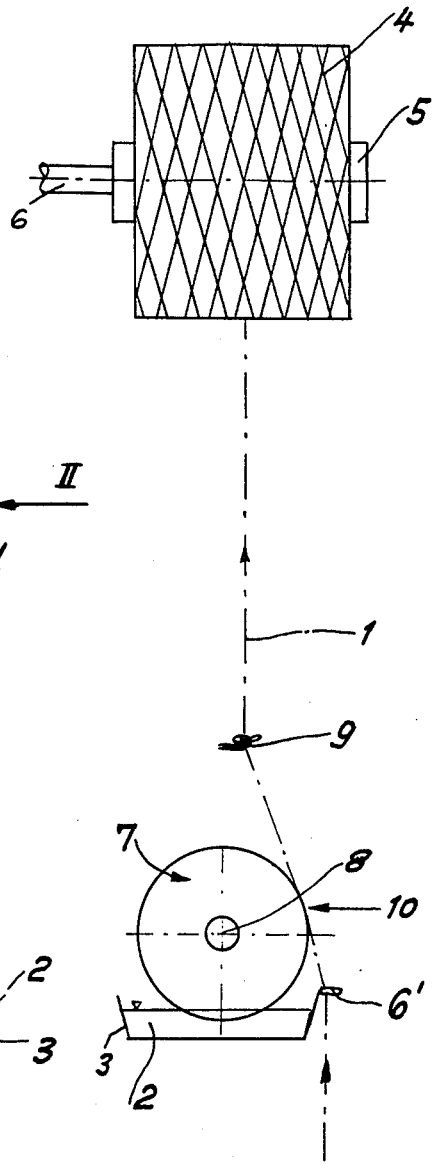
FIG. 2 — a side view of the installation according to FIG. 1 in the direction of arrow II.

In FIGS. 1 and 2 there is represented in a schematic form an installation for the treatment of a thread 1 or the like by means of a treatment fluid 2. A treatment fluid can be fluid wax, oil or the like, which can be located in a vat 3. The treatment of the thread 1 occurs during the winding of the thread on a bobbin 4 or the like. The bobbin 4 with its pirn tube 5 sits on a hinted spool spindle 6 which rotates at constant rotational speed.

At the beginning of the winding process, the thread 1 is then fixed to the pirn or quill tube 5, which has a diameter of $d_1$. Yet the thread is in a first stationary thread guide 6' at about the height of the edge of the vat 3 and runs under contact with the peripheral area of a treatment roller which turns at constant number of rotations through a second thread guide 9, which is movable substantially parallel to the axis of the treatment roller 8 toward the pirn tube 5. The thread 1 which is stretched between the thread guides 6' and 9 lies over a certain length against the peripheral area of the treatment roller 7. Since the roller 7 dips with its peripheral area into the vat with the treatment fluid, it carries with each turn constantly a film of treatment fluid. Into this film enters the thread 1 at point 10 (FIG. 2) and is thus treated, for example, in order to improve its later seam thread qualities, such as its slipping through the eye of a needle or, more specifically, the stitching hole in textiles or the like.

During the winding process, the diameter of the cross-wound bobbin 4 constantly increases until it reaches, for example, the diameter $d_2$ indicated in FIG. 1. Since the number of rotations of the pirn tube is constant, the speed of the thread increases with the increase in diameter. This relationship is derived from the diagram presented in FIG. 1. On the abscissa the diameter $d$ can be entered, wheras on the ordinate $v$ the depending varient, i.e. the speed is entered. The diagram indicates the speed of the thread $v_1$ at a diameter $d_1$ of the pirn tube 5 and the thread speed $v_2$ at the indicated diameter $d_2$.

As can be determined easily, spatially the axis of the pirn tube 5 and the axis of the treatment roller 8 are perpendicular to each other. This gives the possibility, corresponding to the increase of the diameter of the cross-spool $d$, to move the second thread guide 9 in the direction of the arrow 11 in such a manner that the thread 1 also displaces parallel to itself within the area between the second thread guide 9 and the bobbin 4. The displaced second thread guide is designated 9'. As can be determined from FIG. 1 as a result of the increasing shift of the thread guide 9 there occurs an increased inclination of the thread 1 in the area between the first thread guide 6' and the second thread guide 9 or 9', respectively. Through the increasing inclination (see thread zone 1') there occurs an increase in the contact length between thread 1 and the circumference of the treatment roller 7. By this the thread can absorb a greater quantity of the treatment fluid which is present in a film on the peripheral area of the treatment roller.

Figure 3:
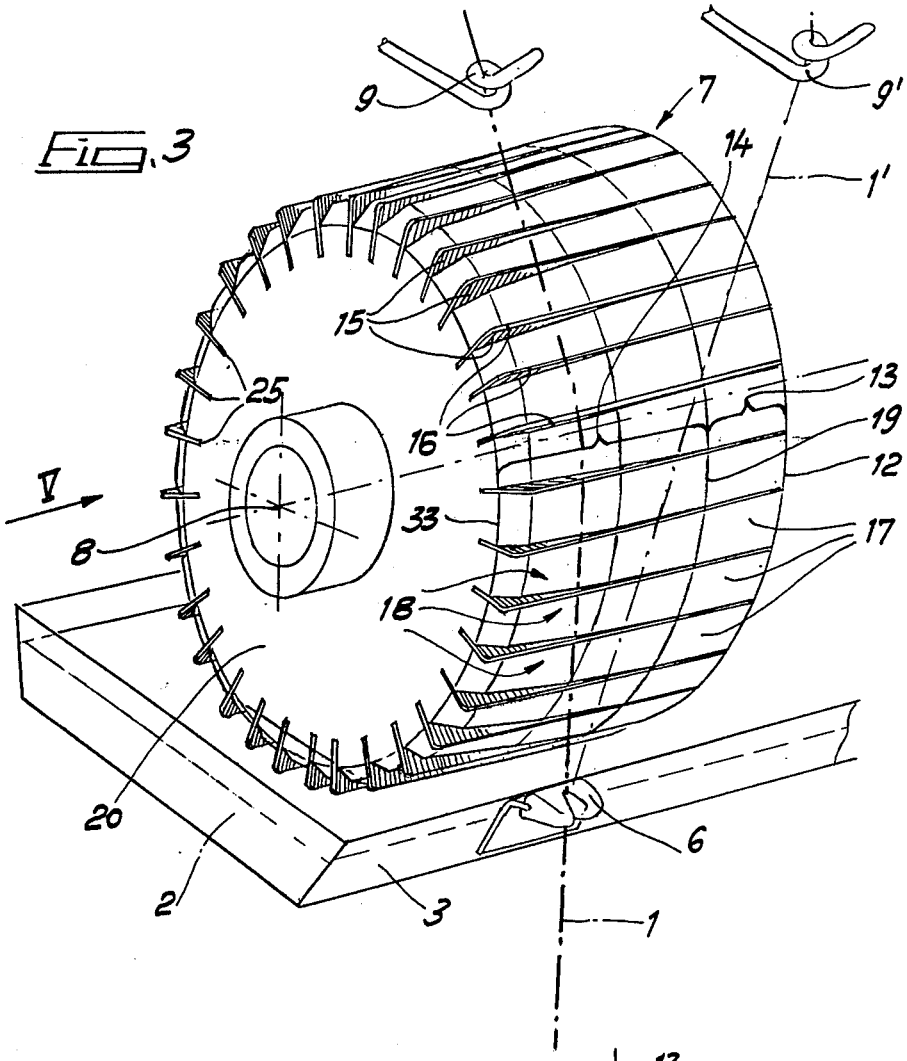
FIG. 3 — a first embodiment of a treatment roller in accordance with the invention in perspective presentation.

According to the invention the treatment roller 7 presents, bordering on its one front side 12 (FIGS. 1 and 2), a cylindrical first circumference segment area 13 and, adjacent to it, a second circumference segment area 14 with radially protruding, axially stretched, narrow webs 15, whose free edges 16 merge into the peripheral surface 17 of the cylindrical circumference segment area 13 and provide between them grooves 18. Furthermore, the groove depth $t$ (FIG. 4), which begins at zero value on the inner borderline 19 of the cylindrical circumference segment area 13, increases to the other front side 20 (FIGS. 1 and 3) of the treatment roller 7 over-proportionally over the groove length L, thus in the direction of arrow A in FIG. 4.

Figure 6:
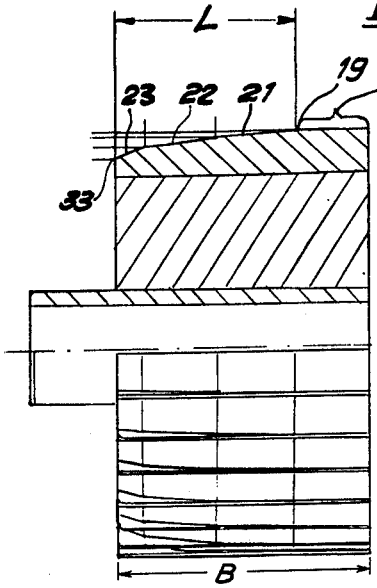
FIG. 6 — a top view of the treatment roller according to FIGS. 3 and 5, in partial cross-section along the line VI—VI in FIG. 5.

Preferably the second circumference segment 14 of the treatment roller 7 consists of several truncated cone surfaces 21, 22, 23 bordering on each other, with increasingly truncated opening angles towards the other front surface 20. In the exemplary embodiment represented in FIGS. 3 to 6 three truncated cone surfaces 21, 22 and 23 are present. The embodiment according to FIG. 7 differentiates merely in that a fourth truncated cone surface 24 has been installed. In the sectional side-views drawn in FIGS. 6 – 8 the border line 19 between the first cylindrical circumference segment 13 and the thereto attached second circumference segment has to be identified as a point. In the embodiment in accordance with FIG. 7, the opening angles $\alpha$ and $\alpha'$ are indicated, i.e. for clearness' sake only for the truncated cones or the truncated cone surfaces 23 and 24, respectively.

Figure 7:
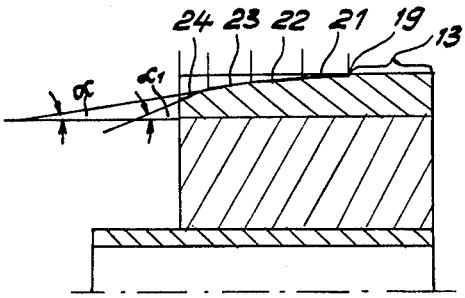
FIG. 7 — a view corresponding to FIG. 6 of a second embodiment of the treatment roller.

As can easily be determined, the second circumference segment 14 has both in the embodiment according to FIGS. 3 – 6 as well as in the embodiment according to FIG. 7 a rotational symmetrical surface being increasingly inclined towards the other front side 20 of the treatment roller 7.

In this form the treatment roller 7 with its webs 15 can be made in a single piece. This is, however, very costly. It is preferred, in the peripheral area of the treatment roller 7 to install radially and at a distance from each other in the peripheral direction axial slits 25, in which substantially rectangular plates are fixedly inserted, said plates corresponding in their lengths to the width B of the roller (FIG. 6) and forming the webs 15.

The free edges 16 of the webs or the plates 15, respectively, in the illustrated embodiment represent generatrices of a cylindrical surface in space and go over on the borderline 19 of the first circumference segment 13 in the there cylindrical peripheral area of the treatment roller 7.

The radially outwardly oriented corners 26 of the webs or plates 15, respectively, are suitably rounded in order to avoid damage to the thread as well as to the hands of an operator.

Figure 4:
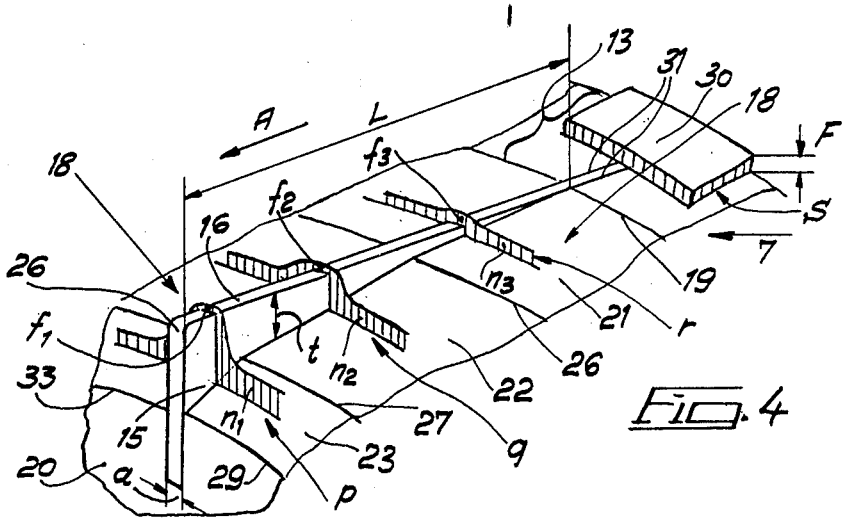
FIG. 4 — a cut-away view of the surface of the treatment roller according to FIG. 3 on a larger scale and in a perspective presentation.
Figure 5:
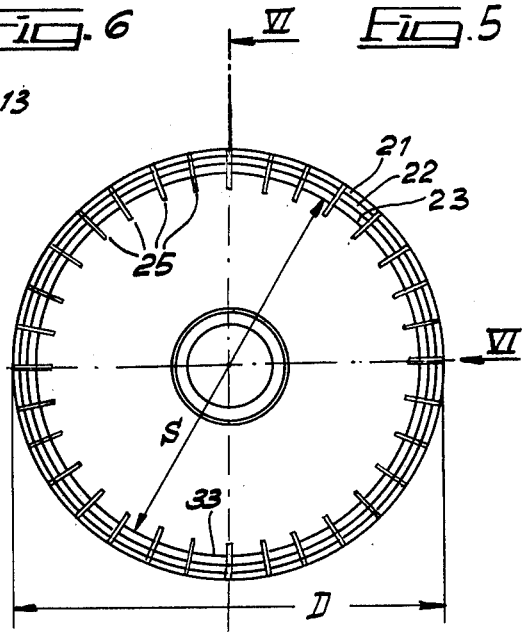
FIG. 5 — a side view of the treatment roller in the direction of arrow V in FIG. 3.

As has already been indicated, in the embodiment according to FIGS. 3 – 6, three truncated cone surfaces 21, 22 and 23 are provided which form the second circumference segment area 14 of the treatment roller 7. The diameter of the larger base circle of the first truncated cone surface 21 corresponds to the diameter of the treatment roller in the first circumference segment area 13 and with that also the diameter of the borderline 19. The smaller diameter of the truncated cone surface 21 corresponds to the greater base circle 26 (FIG. 4) of the second truncated cone surface 22 and is, according to the preferred embodiment, about 3 mm smaller than the diameter of the treatment roller D (FIG. 5). Further, the smaller basis circle diameter of the second truncated cone surface 22, which is defined by the larger basis circle 27 of the third truncated cone surface 23, is preferably about 6 mm smaller than the diameter D of the treatment roller 7. Finally, the basis circle diameter of the smaller basis circle 29 of the third truncated cone surface 23 is about 10 mm smaller than the diameter of the treatment roller 7. These are the preferred measurements of a built and successfully used treatment roller. The total axial length of the three joint truncated cones corresponding to the surfaces 21, 22 and 23 which in turn correspond to the length L of the grooves, was in this embodiment about 45 mm. The length of both the second and third truncated cones corresponding to surfaces 22 and 23 amounted to about 15 mm, the length of the third truncated cone was about 5.6 mm.

The diagrammatic view of FIG. 4 clearly indicates the distribution of the treatment fluid and corresponding to that the different film thicknesses of the treatment fluid. Through the adhesion of the treatment fluid to the treatment roller 7 there is formed in the area of the grooves 18, as well as along the length of the groove L an uneven film of treatment fluid, which on the borderline 19 goes over into the area of the first cylindrical circumference 13 into the film there present, which in FIG. 4 is only partially represented namely in the square cut-out 30 with a film thickness F.

In the area of the third truncated cone surface 23 and because of the there given considerable groove depth of $t$, the thread 1 can lie only on the free edges 16 on which there is located a film of treatment fluid which has but a relatively small thickness $f_1$. Since according to the invention the thickness $a$ of the webs or plates 15, respectively, is relatively small, the thread 1 obtains at the beginning of the winding process, when it is still located near the other front side 20, not only a proportionally smaller quantity of of treatment fluid, but moreover there is present but a small contact surface between the thread 1 and the treatment roller 7, namely only at the surfaces of the edges 16 of, for example, two to four webs or plates 15, respectively. Since in this area the speed of the thread is at its lowest (see clarifications to FIG. 1), the thread 1 nevertheless obtains a satisfactory amount of treatment liquid. As further has been explained on the basis of FIGS. 1 – 3, the thread in its length 1' becomes inclined with increasing speed of the thread because of the increasing diameter of the cross-wound bobbin and moves towards the one front side 12 or the circumference area 13, respectively. Because of this the contact area increases, which in conjunction with the modifying film profile, i.e. the modifying film thickness (see FIG. 4, fluid profile p, q, r, s) results in the fact that the thread even at the highest obtainable thread speeds still gets a satisfactory amount of treatment fluid. This is based on the fact that the film thicknesses on the free edges 16, beginning with the film thickness $f_1$ over the exemplary film thickness $f_2$ and $f_3$ increase up to the film thickness F, while at the same time the film thicknesses $n$ on the basis of the grooves, which near the other front side 20 are actually greater than the film thickness F, are constantly declining towards the borderline 19. For this in the areas of the truncated cone surfaces 21, 22, 23 the film thickness $n_1$, $n_2$ and $n_3$ are indicated. At the borderline 19, i.e. at the transition to the cylindrical circumference segment 13 one obtains then that $f_3 = n_3 = F$. Attention is drawn to the fact that the lines 31 in the circumference segment 13 are the borderlines of a plate 15 only; it is understood that the edge 16 of the plate 15 is here continuously fitting into the cylindrical circumference segment area.

Figure 8:
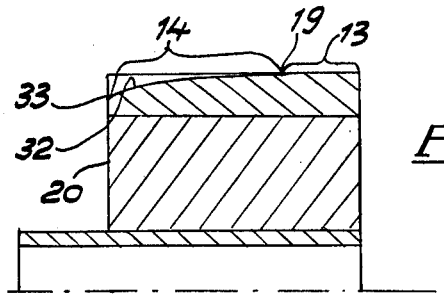
FIG. 8 — a view corresponding to FIG. 7 of a third embodiment of a treatment roller.

For the obtained advantageous result, namely the uniform transfer of the treatment fluid to the thread 1, one also has to consider as important, besides of the low thickness $a$ of the webs, i.e. plates 15, additionally the special profile, i.e. the curvature of the basis of the grooves. It is understood that in an infinite number of correspondingly executed truncated cone surfaces the basis of the grooves transforms itself in a constantly curved surface. The third embodiment indicated in FIG. 8 is, therefore, characterized by the fact that the circumference surface allocated to the second circumference segment area 14 is a rotational symmetrical surface 32 merging at the inner borderline 19 into the cylindrical circumference segment area 13 of the treatment roller 7, said surface being increasingly curved towards the other front side 20. The curve radius of the surface 32 decreases, therefore, towards the other front side 20 constantly. For the rest as well in this embodiment as in the other according to FIGS. 3 – 6 a cutting circle diameter S (see FIG. 5) is preferred, determined by the cut with the other front side 20, which is about 10 mm smaller than the diameter D of the treatment roller 7. The cutting circle, which at the same time represents the left edge of the treatment roller 7, is indicated by reference numeral 33.

Figures 9, 10:
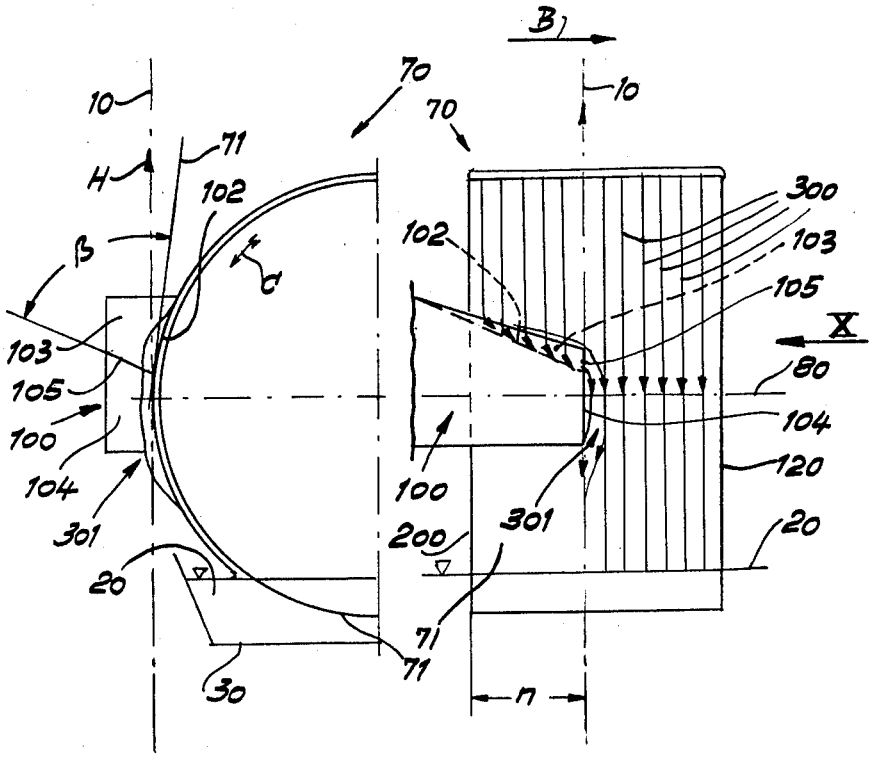
FIG. 9 — a top view of the circumference surface of a fourth embodiment of the treatment roller in accordance with the invention.
FIG. 10 — a side view in the direction of the arrow X in FIG. 9.

In FIGS. 9 and 10 a further solution according to the invention is represented, namely a treatment roller 70 for the treatment of a thread 10 which has a smooth cylindrical peripheral surface dipping again into a container 30 with a bath 20 of treatment fluid. In accordance with the invention, a skimmer 100 having a skimming surface 103 is installed, which in dependency from the speed of the thread, is slideably movable from the other front side of the treatment roller 70 to the one front side 120, lying against the peripheral surface 71 of the treatment roller 70 with its covering contact surface U (FIG. 9), and being formed so that it concentrates the skimmed-off treatment fluid in that area of the treatment roller 70, in which the thread 10 is guided. The shift of the thread guide 100 occurs thus in the direction of the arrow B and conveniently parallel to the axis 80 of the treatmentroller. The width of the skimmer 100 should correspond at least to the width of the treatment roller 70, so that the same can skim off the entire width.

In the embodiment that has been illustrated, the skimming surface 103 being opposed to the treatment fluid is inclined towards the free end 104 thereof, said skimming surface having a skimming edge 102 abutting against the peripheral surface 71 of the treatment roller 70, so that said skimming edge 102 is correspondingly curved and that the skimmed-off treatment fluid is led towards the free end 104 and beyond same. Suitably the overall surface of the skimmer abutting against the peripheral surface of the treatment roller 70 will have a hollow cylindrical curvature, which with this becomes a contact surface, so that the skimmer always lies close to the peripheral surface 71. The stream lines 300 indicated in FIG. 9, show how from the peripheral surface 71 of the treatment roller 70 the there present film of the treatment fluid is skimmed-off by the skimming edge 102 and is led by the skimming surface 103 towards the free end 104 of the skimmer 100, so that obviously a thicker fluid stream 301 is present there.

In order to make sure that the skimmed-off treatment fluid does not only not run over the skimmer but also that it remains as much as possible at the peripheral surface 71, it is advantageous that the skimming surface 103 is additionally inclined in a direction perpendicular to the direction of the first inclination in such a manner that it forms with the tangent at the circumference of the treatment roller a pointed intake angle $\beta$. It is pointed out that the angle $\beta$ as depicted in FIG. 10 does not correspond to the real angle; the real angle $\beta$ allows itself only to be represented in a cutting plane being perpendicular to the skimming surface 103. For the demonstration purposes at hand, representation in the drawing plane according to FIG. 10, which is perpendicular to the axle of the treatment roller 80, will be sufficient.

As can be determined easily, the free end 104 of the skimmer 100 shows a front side which is essentially transverse to the axis 80 of the treatment roller 70. Along said front side the thread 10 is guided. Since the thread 10 at the same time should be in contact with the peripheral surface 71, it is constantly in the stream 301 of the fluid, which is the stronger and thus brings more treatment fluid to the thread 10, the further the skimmer 100 is moved in the direction of the arrow B and thus the more it catches from the fluid film and skims it off, which fluid film in FIG. 9 is above the skimmer 100. In the area underneath the skimmer 100, which in FIG. 9 shows no stream lines, there is practically no treatment fluid any longer until the peripheral surface 71 enters into the bath 20. It is understood that in the embodiment in accordance with FIGS. 9 and 10, the treatment roller 70 moves in the direction of arrow C (FIG. 10), i.e. against the movement direction of the thread 10, (see arrow H). It is further understood that there must be a direct dependency between the speed of the thread or the diameter of the bobbin 4, respectively, and the movement of the skimmer 100 in the direction of the arrow B. For example, a thread guide (not shown) leading the thread might be installed above the treatment roller 70 and could be coupled with the skimmer 100 in such a manner that each movement of the thread guide corresponding to the increase in the diameter of the cross-wound bobbin (see FIG. 1), carries along the skimmer 100 accordingly.

I claim:

1. In apparatus for the treatment of thread and the like with a treatment fluid such as liquid wax, oil and the like, during the winding process of the thread on a cross-wound bobbin and the like mounted on a pirn tube rotating at constant speed, said apparatus including a treatment roller driven at a constant rotational speed, one part of the peripheral area thereof dipping into a bath containing the treatment fluid, said treatment roller having on its peripheral area axially extending grooves, two thread guides, the first one of said guides being stationary and the second one of said guides being movable substantially parallel to the axle of the treatment roller, and which are installed in such manner that the thread which is stretched therebetween lies against the peripheral area of the treatment roller over a certain length, the improvement which comprises said treatment roller having a cylindrical first circumference segment area adjacent one end of the roller and a second circumference segment area adjacent thereto and having radially disposed and axially extending small webs, the free edges of which enter into the circumference surface of said second cylindrical circumference segment area and which form therebetween said axial grooves, said grooves having a depth which begins at zero on the inner borderline of said first cylindrical circumference segment area and which toward the other end of said treatment roller increase overproportionally to the groove length.

2. The improvement claimed in claim 1, wherein said second circumference segment area of the treatment roller comprises several truncated cone surfaces bordering on each other, said surfaces showing towards the said other end, increasingly truncated cone opening angles.

3. The improvement claimed in claim 2, wherein three truncated cone surfaces are provided in said second circumference segment area, wherein the diameter of the largest base line of the first said truncated cone surface corresponds to the diameter of the treatment roller in said first circumference segment area, the smaller base line thereof, defining the greater base line of the second truncated cone surface being about 3 mm smaller than the diameter of said treatment roller, wherein the base circle diameter defining the larger base circle of the third said truncated cone surface is about 6 mm smaller than the diameter of said treatment roller, and wherein the smaller base circle diameter of the third said truncated cone surface is about 10 mm smaller than the diameter of said treatment roller.

4. The improvement claimed in claim 3, wherein the total axial length of said joined three truncated cones is about 45 mm, the length of both truncated cones bordering on said other end of said treatment roller representing said second and third truncated cone surfaces is about 15 mm, and wherein the length of said third truncated cone forming said third truncated cone surface is about 5.6 mm.

5. The improvement claimed in claim 1, wherein said second circumference segment area represents a rotational symmetrical surface with a progressively greater curvature towards said other end of said treatment roller.

6. The improvement claimed in claim 5, wherein the rotational symmetrical surface merging at the inner borderline into the cylindrical circumference segment area of said treatment roller and having a curved surface which increases toward said other end, has a cutting circle being about 10 mm smaller than the diameter of said treatment roller, said cutting circle representing the cut between the said surface and the said other end.

7. The improvement claimed in claim 1, wherein said treatment roller has axial slots on its peripheral area disposed radially and at a distance from each other in the circumferential direction, in which slots rectangular plates are inserted in a fixed position, said plates corresponding in their length to the axial length of the roller and forming said webs.

8. The improvement claimed in claim 7, wherein the said plates have free edges, the said free edges forming generatices of a cylindrical surface in space and at the borderline of said first circumference segment area merge into the cylindrical peripheral area of said treatment roller.

9. The improvement claimed in claim 8, wherein the corners of the plates oriented radially toward the outside are rounded off.

* * * * *